US005410778A

United States Patent [19]

Langevin

[11] Patent Number: 5,410,778

[45] Date of Patent: May 2, 1995

[54] CRANK HANDLE FOR WINDOW PANE OR THE LIKE

[76] Inventor: Yves Langevin, 136 Hickson Street, St-Lambert, Quëbec, Canada

[21] Appl. No.: 112,990

[22] Filed: Aug. 30, 1993

[51] Int. Cl.[6] ..... B25G 1/04

[52] U.S. Cl. ..... 16/115; 74/545

[58] Field of Search ..... 16/115, 121, 110 R; 74/543, 544, 545, 528, 546, 547, 548

[56] References Cited

U.S. PATENT DOCUMENTS

| | | | |
|---|---|---|---|
| 1,274,471 | 8/1918 | Todd | 74/545 |
| 3,007,348 | 11/1961 | Barnes | 16/110 R |
| 3,159,392 | 12/1964 | Pollack | 74/548 |
| 4,294,134 | 10/1981 | Mori et al. | 74/545 |
| 4,390,203 | 6/1983 | Lutz et al. | 74/545 |
| 4,567,692 | 2/1986 | Vogt et al. | 74/545 |
| 4,615,236 | 10/1986 | Boots | 74/545 |
| 5,168,770 | 12/1992 | Ellis | 74/547 |
| 5,201,241 | 4/1993 | Pollack, Jr. | 74/528 |

*Primary Examiner*—P. Austin Bradley
*Assistant Examiner*—Chuck Y. Mah
*Attorney, Agent, or Firm*—Cushman, Darby & Cushman

[57] ABSTRACT

A handle for mounting to a crank shaft operable to actuate a movable structure, such as a window pane, comprises first and second members which are pivotally connected to one another through a hinge axis. The members have intermediate sections with a complementarily shaped groove-and-projection configuration so that when the handle is not in operative condition, one member is folded over the other member with the groove and the projection in an imbricated position in a compact arrangement.

4 Claims, 1 Drawing Sheet

CRANK HANDLE FOR WINDOW PANE OR THE LIKE

FIELD OF THE INVENTION

The present invention pertains to a handle for mounting to a crank shaft operable to actuate a movable structure, such as a window pane.

BACKGROUND OF THE INVENTION

There exists at present many types of mechanisms for opening windows. One such mechanism consists of a crank shaft mounted to the window pane and operable by means of a handle. Such handle, however, while being essential to the operation of the opening function, is a problem. Indeed, any type of interior decoration for a window is faced with the presence of such handles due principally to the space that it occupies on the interior side of the window. Curtains will be caught in the handles, which is a hinderance continuously met by users or by decoration professionals.

OBJECTS AND STATEMENT OF THE INVENTION

The present invention therefore provides a crank handle which avoids the above described problems of presently used handles.

The present invention relates to a handle for mounting to a crank shaft operable to actuate a movable structure which comprises: a first member having a part adapted to be fitted to a crank shaft, and a pivotable second member having an inner end adapted to be connected about a hinge axis to an outer end of the first member and an opposite outer end adapted to receive a knob. The first and second members each have intermediate sections displaying outer faces with complementarily-shaped groove and projection means; these intermediate sections extend, when in operative condition, along a longitudinal axis perpendicular to the hinge axis. The invention is characterized in that, when the second member is pivoted about the hinge axis, the groove and projection means imbricate and the knob extends adjacent to the crank part of the first member.

In one embodiment of the invention, means are provided on groove and projections means to secure the two members in the imbricated position.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF A PREFERRED EMBODIMENT

Figure 1:
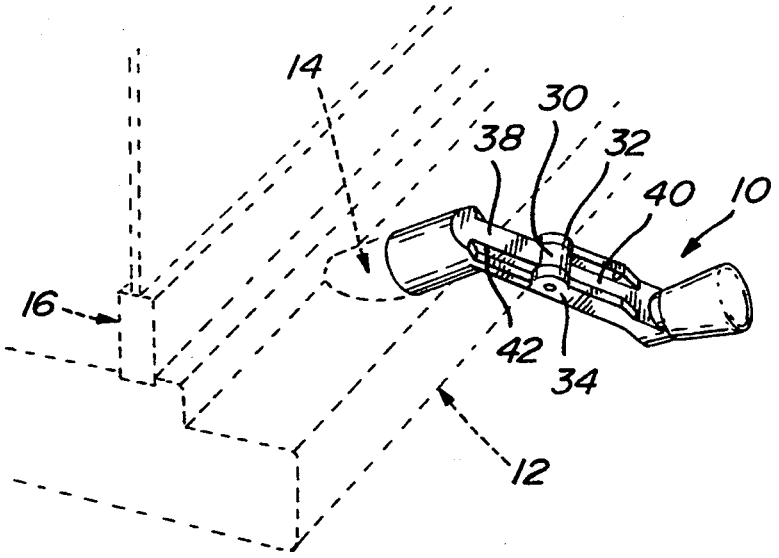
FIG. 1 is a perspective view of the crank handle of the present invention.

Referring to FIG. 1, there is shown a crank handle, generally denoted 10, mounted to a window sill 12 from which extends a shaft 14 connected to a window pane 16 for opening and closing such pane.

Figure 2:
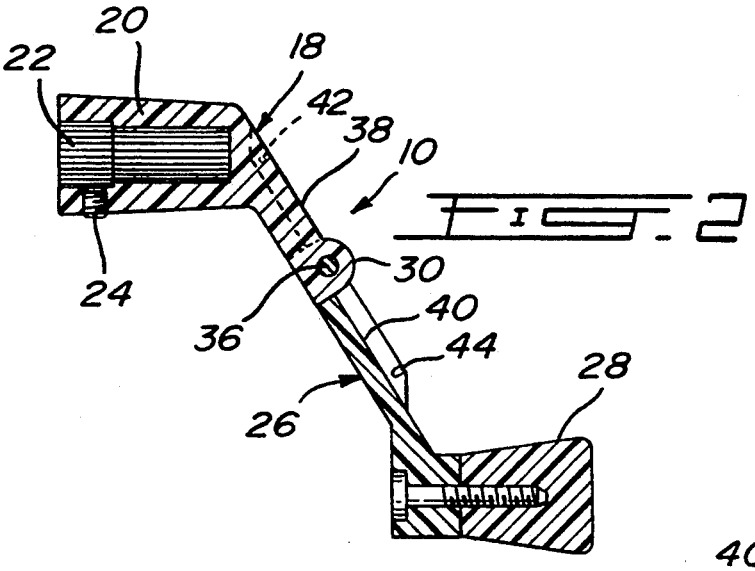
FIG. 2 is a longitudinal cross-sectional view thereof.

Referring also to FIG. 2, the handle 10 comprises a first member 18 having, at one end, part 20 with a bore 22 adapted to engage and be fastened by means of a screw 24 to the crank shaft 14 of the window structure. The handle also comprises a second member 26 which has a finger-gripping rotatable knob 28 which is grasped by a user for opening and closing the window pane.

The first member 18 has an outer end 30 which is shaped and dimensioned to fit between a pair of correspondingly shaped ears 32 and 34 at the inner end of the second member 26. A hinge pin 36 extends through ends 30, 32 and 34, thus allowing the second member 26 to be hingedly pivoted relative to the first member 18.

Figure 4:
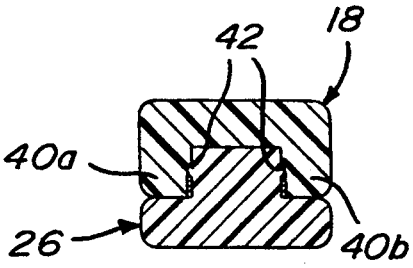
FIG. 4 is a cross-sectional view taken along lines 4—4 of FIG. 3.
Figure 3:
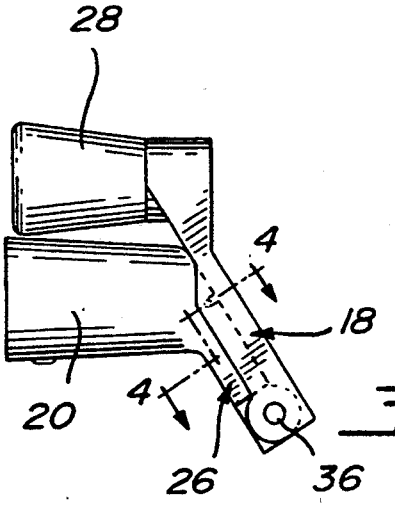
FIG. 3 is an elevational view thereof showing the handle in the pivoted position.

The first member 18 has an intermediate section that displays a rectangular T-shaped projection 38 while the second member 26 has an intermediate section that displays a rectangular U-shaped groove 40, the cross-section of which corresponds substantially to that of projection 38 (see FIG. 4) so that, once the second member 26 is pivoted about hinge 36, the groove and projection will imbricate. The finger-gripping knob 28 thereafter rests adjacent to the crank engaging part 20, thus greatly reducing the area occupied by the handle when not in usé.

In order to ensure that the two members remain in the imbricated position, means are provided in the intermediate sections of each part to secure them together. In the embodiment illustrated, this securement is achieved by a pair of opposite small rounded projections 42 disposed on each side of the lateral faces of projection 38, which engage in opposite recessed areas 44 in the inner walls of the longitudinal sides **40*a* and 40*b* of the intermediate section of member 18 (see FIG. 4**).

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A crank handle for a crank shaft mounted to a window sill operable to actuate a movable window pane comprising: a first member having an inner end, an outer end and an intermediate section between said ends, said outer end defining a part adapted to be engaged to the crank shaft, and a pivotable second member having an inner end, an outer end and an intermediate section between said ends, said inner end of said second member being connected about a hinge axis to said outer end of said first member said outer end of said second member carrying a knob; said intermediate sections having outer faces having complementarily shaped groove and projection means; said intermediate sections being substantially of equal length and extending, when in operative condition, along a longitudinal axis perpendicular to said hinge axis, characterized in that, when said second member is pivoted about said hinge axis, said groove and projection means imbricate so that said intermediate sections overlap one another to reduce by half the length of said handle; said knob extending parallel and adjacent to said crank engaging part of said first member.

2. A crank handle as defined in claim 1, wherein said groove and projection means define respective T-shaped and U-shaped cross-sections whereby when, in the imbricated position, the intermediate sections define together a substantially rectangular cross-section.

3. A crank handle as defined in claim 1, wherein said groove and projection means include cooperating protuberance and recess means thereon for securing said intermediate sections in the imbricated position.

4. A crank handle as defined in claim 1, wherein said groove means are located on the intermediate section of the first member and said projection means are located on the intermediate section of the second member.

* * * * *